US006056461A

United States Patent [19]

Yun

[11] Patent Number: 6,056,461

[45] Date of Patent: May 2, 2000

[54] DEVICE FOR FEEDING A RECORDABLE PAPER IN AN INK JET PRINTER

[75] Inventor: Suk-jin Yun, Suwon, Rep. of Korea

[73] Assignee: SamSung Electronics Co., Ltd., Suwon, Rep. of Korea

[21] Appl. No.: 09/216,727

[22] Filed: Dec. 21, 1998

[30] Foreign Application Priority Data

Dec. 19, 1997 [KR] Rep. of Korea ..... 97-38938

[51] Int. Cl.[7] ..... B41J 13/03

[52] U.S. Cl. ..... 400/624; 400/629; 271/22; 271/118

[58] Field of Search ..... 400/625, 624, 400/628, 629; 347/104, 105; 271/22, 118, 126, 147, 160

[56] References Cited

U.S. PATENT DOCUMENTS

| | | | |
|---|---|---|---|
| 4,023,792 | 5/1977 | Punnett et al. | 271/118 |
| 4,319,740 | 3/1982 | Ulseth | 271/22 |
| 4,958,950 | 9/1990 | Kobayashi et al. | 400/629 |
| 5,152,622 | 10/1992 | Rasmussen et al. | 400/624 |
| 5,386,983 | 2/1995 | Ando | 271/118 |
| 5,419,543 | 5/1995 | Nakamura et al. | 400/624 |

*Primary Examiner*—Christopher A. Bennett
*Attorney, Agent, or Firm*—Robert E. Bushnell, Esq.

[57] ABSTRACT

Disclosed is a device for feeding a recordable paper in an ink jet printer. The device according to the present invention is designed such that a recordable paper stacking plate is upward shifted by a reciprocal movement of a carriage to be positioned at a paper feeding position at an initial printing so that a recordable paper is in close contact with a feed roller. Thus, the recordable paper is picked up by a rotation of the feed roller and moved to a base frame. As a result, it is possible to save a time for feeding the recordable paper and printing data on the recordable paper. Further, there is advantage in that a time for picking up the recordable paper can be reduced by using a CR motor having a large torque.

16 Claims, 5 Drawing Sheets

DEVICE FOR FEEDING A RECORDABLE PAPER IN AN INK JET PRINTER

CLAIM OF PRIORITY

This application makes reference to, incorporates the same herein, and claims all benefits accruing under 35 U.S.C. §119 from applications for A DEVICE FOR FEEDING A RECORDABLE PAPER IN AN INK JET PRINTER earlier filed in the Korean Industrial Property Office on Dec. 19, 1997, and there duly assigned Serial No. 38938/1997.

BACKGROUND OF THE INVENTION

1. Field of the Invention

The present invention relates to a device for feeding a recordable paper in an ink jet printer, and more particularly to a device for feeding a recordable paper in an ink jet printer capable of feeding the recordable paper quickly, in which the recordable paper is moved at a pick-up position of a feed roller in a manner that a plate for stacking the recordable paper thereon is upward shifted by using a reciprocation of a carriage which contains ink cartridges and moves along a guide shaft.

2. Description of the Prior Art

In an ink jet printer according to the conventional art, recordable papers stacked on a plate for feeding the recordable paper is fed by a pick-up roller between a friction roller and a feed roller while the pick-up roller is rotated by a driving force of an electric motor. When the recordable paper reaches a base frame, a carriage is reciprocally moved along a guide shaft to make a printhead print data on the recordable paper. Then, the paper on which the data are printed is discharged out of the printer by a discharging roller.

The device for feeding the recordable paper in the ink jet printer according to the conventional art includes a plate for stacking the recordable paper thereon and a pick-up roller for picking-up a sheet of paper on the stacking plate and feeding the paper to the feed roller. The device also has a feeding spring between a main frame and the stacking plate.

Since a LF electric motor which is used as a power source has a low speed, it is difficult to drive the pick-up roller and different driven rollers. As a result, there is a problem in that it takes much time to feed the recordable paper and print the data on the recordable paper.

SUMMARY OF THE INVENTION

The present invention has been made to overcome the above described problem of the prior art.

It is an object of the present invention to provide a device for feeding a recordable paper in an ink jet printer capable of feeding the recordable paper quickly, in which the recordable paper is moved at a pick-up position of a feed roller in a manner that a plate for stacking the recordable paper thereon is upward shifted by using a reciprocation of a carriage which contains ink cartridges and moves along a guide shaft.

To accomplish the above object of the present invention, there is provided a device for feeding a recordable paper in an ink jet printer, comprising:

means which is reciprocally moved along a guide shaft of a main frame, for printing characters;

a plate which is disposed at a front side of the main frame, for stacking the recordable paper thereon;

a feed roller which is disposed at a front portion of the tray in the main frame, for feeding the recordable paper stacked on the plate to a printing region of the printing means;

means for receiving a driving force from the printing means at an initial printing, the means being disposed out of the printing region of the printing means; and means for shifting the plate upward and downward using the driving force receiving means so that the recordable paper is positioned at a pick-up position of the feed roller.

The device for feeding the recordable paper in the ink jet printer further comprises means for preventing an interference between the printing means and the driving force receiving means during the reciprocation of the printing means in such a manner that when the feed roller is reversely rotated at the initial printing, the driving force receiving means is made in contact with the guide shaft to receive the driving force during the reciprocation of the printing means while the driving force receiving means is disconnected from the guide shaft when the printing proceeds.

The interference preventing means includes a clutch which is mounted on a shaft of the feed roller and moves forward and backward and a tension spring supporting the driving force receiving means and the clutch.

The plate shifting means includes a rotating means for converting a linear movement of the printing means into the rotating movement when the printing means pushes the driving force receiving means, a rotating shaft which is rotated by the rotating means, means which is disposed below the plate for stacking the recordable paper thereon, for contacting the plate to the feed roller closely using a rotation of the rotating shaft, and means for receiving a rotation force of the rotating shaft and for moving the contacting means.

Further, the rotating means includes a gear shaft which is combined with a lower end of the driving force receiving means to be rotated, a first bevel gear which is mounted on the gear shaft to be rotated together with the gear shaft, and a second bevel gear which is mounted on the rotating shaft and engaged with the first bevel gear to rotate the rotating shaft.

The contacting means includes a shifting plate for shifting the plate for stacking the recordable paper thereon, a guide plate for guiding a leading edge of the stacking plate which is upward shifted by the shifting plate toward the feed roller, and a hinge shaft which is mounted so that a rear end of the shifting plate is pivoted on the hinge shaft and a leading edge of the shifting plate is upward shifted.

The shifting plate is divided into two shifting plates which are connected to guiding section to support the stacking plate, one of two shifting plates being fixed to the guiding section and the other being combined with the guiding section to be slidably moved and positioned according to a size of the recordable paper stacked on the stacking plate.

The shifting means includes a shifting lever for moving the contacting means using the rotation of the rotating shaft and a support for fixing the shifting lever to the rotating shaft.

The device for feeding the recordable paper in the jet printer further comprises an auxiliary paper stacking plate for supporting the recordable paper fed to the stacking plate and a discharged paper stacking plate on which a discharged paper is stacked in the main frame.

A plurality of the auxiliary stacking plates are designed to be stacked on each other and respectively have a width gradually decreased from a rear end to a front end thereof, of which a lower plate is received in a bottom portion of an upper plate.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENT

Hereinafter, a device for feeding a recordable paper in an ink jet printer according to an embodiment of the present invention will be described in detail with reference to accompanying drawings.

Figure 1:
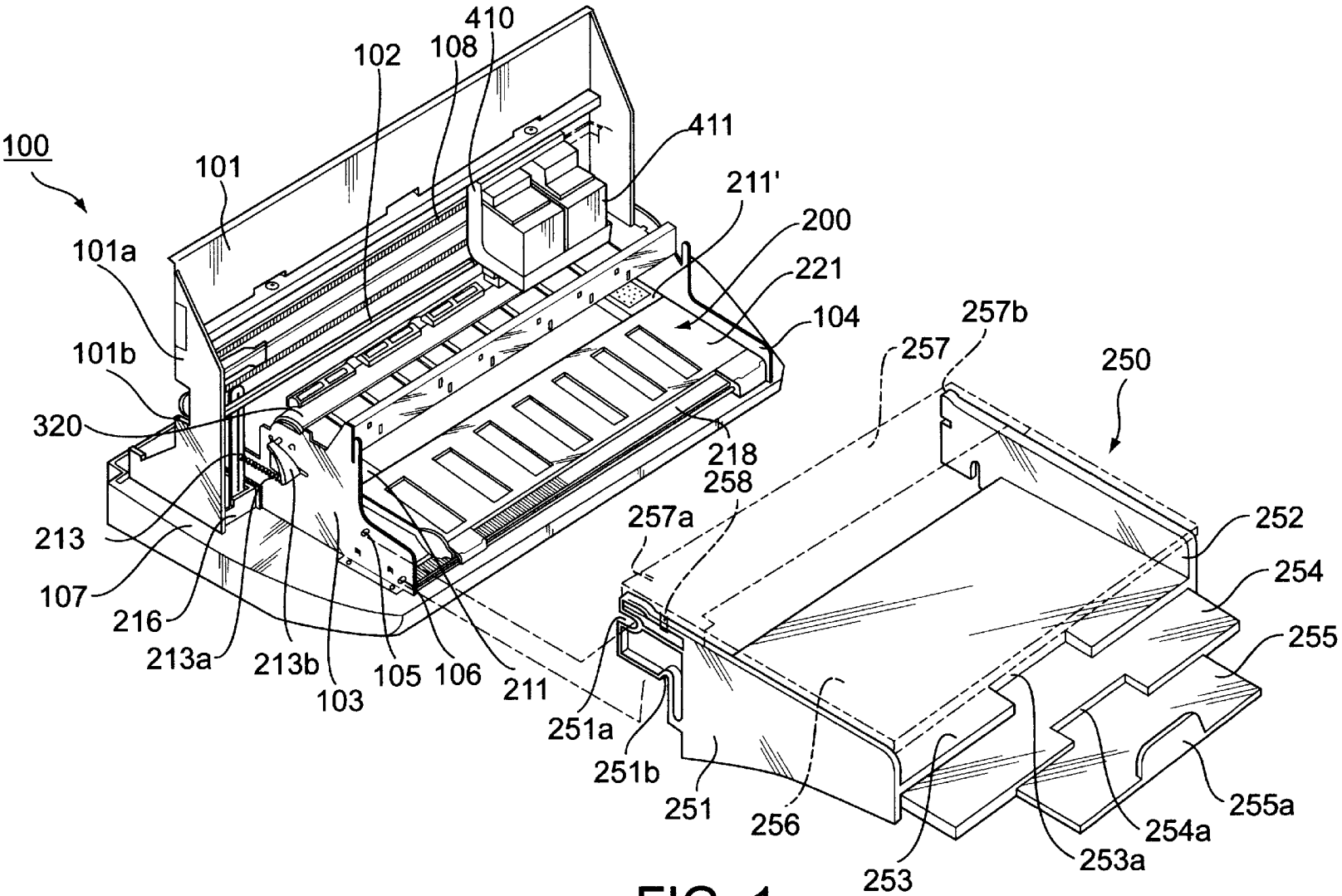
FIG. 1 is a perspective view of an ink jet printer according to the present invention.
Figure 2:
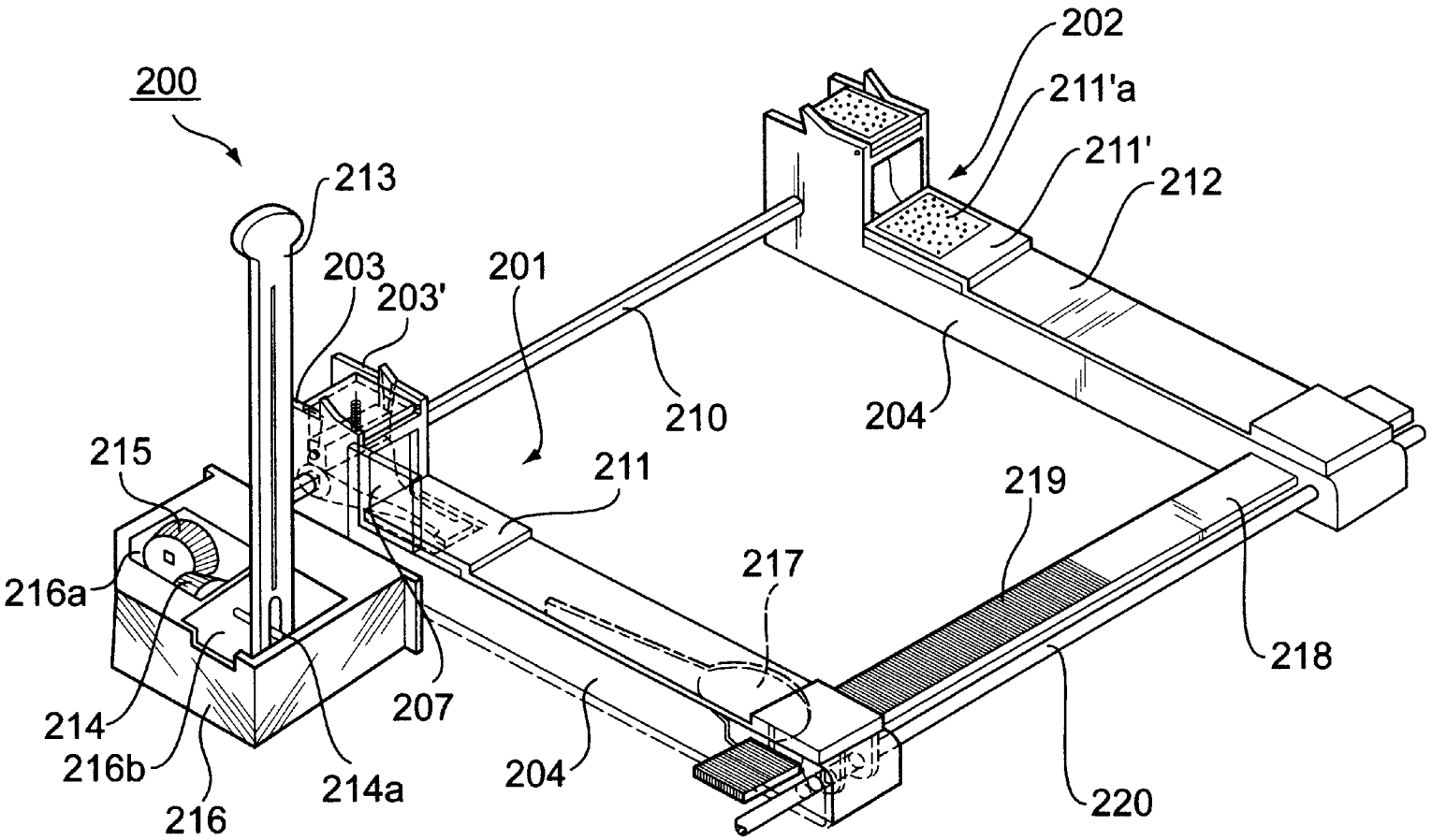
FIG. 2 is a perspective view of means for shifting a recordable paper stacking plate according to the present invention.

Referring to FIGS. 1 and 2, the ink jet printer 100 according to the present invention includes a device 200 for feeding the recordable paper which has the recordable paper stacked thereon and is mounted at a front of the ink jet printer 100 to give a convenience to an user.

The device 200 has a stacking plate 221 for stacking the recordable paper thereon and shifting plates 211 and 211' disposed below the stacking plate 221.

The shifting plate 211 is separated apart from the shifting plate 211' and a space is present between the shifting plates 211 and 211'. The stacking plate 221 is disposed on mound 212 of the shifting plates 211 and 211' so that the recordable papers are stacked thereon.

The ink jet printer 100 includes a pair of supporting frames 103 and 104 which respectively have a first projection 105 and a second projection 106 to combine an auxiliary feeding unit 250 with the ink jet printer 100 so that the auxiliary feeding unit 250 has some of the recordable papers stacked thereon.

The auxiliary feeding unit 250 includes an auxiliary stacking plate 253 used for stacking a recordable paper having a larger size, for example A3 sized paper, which has walls 251 and 252 respectively extending from edges thereof upward. The walls 251 and 252 have a first engaging groove 251*a* and a second engaging groove 251*b* so that the auxiliary feeding unit 250 is combined with the main frame of the ink jet printer 100 in such a manner that the first and second engaging grooves 251*a* and 251*b* is engaged with the first and second projections 105 and 106 of the supporting frame 103 and 104.

The auxiliary stacking plate 253 has slidable stacking plates 254 and 255 disposed below a bottom surface thereof. A grip 255*a* is formed to be projected upward from an edge of the slidable stacking plate 255. The auxiliary stacking plate 253 and the slidable stacking plate 254 respectively have grooves 253*a* and 253*b* at an edge thereof to receive the grip 255*a* when the slidable stacking plates 254 and 255 are present in the auxiliary stacking plate 253.

First and second recorded paper receiving plates 256 and 257 are assembled with the auxiliary stacking unit 253 in such a manner as connected through an engaging latch 258 with the walls 251 and 252.

The second recorded paper receiving plate 257 is smaller in a length that the first recorded paper receiving plate 256 and connected with the first recorded paper receiving plate 256 by a hinge. Further, the second recorded paper receiving plate 257 has first and second connecting slots 257*a* and 257*b* formed on an edge thereof to be assembled with the supporting frame 103 and 104.

A clutch 213*b* is mounted on a shaft for the feed roller 320 supported by the supporting frames 103 and 104. A tension spring 213*a* is disposed between the clutch 213*b* and an operation lever 213.

The clutch 213*b* pulls the operation lever 213 to contact with the guide shaft 102 so that the shifting plates 211 and 211' are moved upward as the carriage 410 is reciprocated along the guide shaft 102.

When the recordable paper is fed to a printhead on the carriage 410, the feed roller 320 rotates reversely according to the electric signal of a ROM while the clutch 213*b* rotates in the same direction as the feed roller 320 to make the operation lever 213 connected with the clutch by means of the tension spring 213*a* to be contacted to the guide shaft 102.

In the state, the carriage 410 moving along the guide shaft 102 pushes the operation lever 213 to a wall 101*a* outward so that the operation lever 213 reaches a hole 101*b*. Then, when the feed roller 320 rotates forward while feeding the recordable paper to the printhead, the operation lever 213 is disconnected from the guide shaft 102 by means of the clutch 213*b* mounted on the shaft for the feed roller 320 and is made to be contacted to the main frame 101.

At that time, since the operation lever 213 is spaced from the guide shaft 102, the carriage 401 is not in contact with the operation lever 213 in spite of reciprocally moving along the guide shaft 102.

Thus, the operation lever 213 is in contact with the guide shaft 102 by means of the clutch 213*b* only when the recordable paper is fed to the printhead.

On the other hand, a gear box 216 is assembled to the supporting frame 102 to receive first and second bevel gears 214 and 215 and the operation lever 213.

A reference numeral 107 indicates a base plate on which the main frame 101, the supporting frames 103 and 104, the gear box 216, and the like are disposed. Another reference numeral 108 indicates an encoder strip which detects a signal from a sensor mounted on the carriage 410 while the carriage 410 is reciprocally moved along the guide shaft 102.

FIG. 2 is a view of the device 200 for feeding the recordable paper in the ink jet printer according to the present invention. In FIG. 2, the operation lever 213 is upright and the shifting plates 211 and 211' are present in a rest state and disposed on the supporting plates 204.

The gear box 216 is separately positioned beside a first housing 201. The first and second bevel gears 214 and 215 are received to be engaged with each other in a gear receiving chamber 216*a* defined by the gear box 216. The operation lever 213 is disposed in the other chamber 216*b* as an operation lever receiving section defined in the gear box 216, which is fitted on a first bevel gear shaft 214*a* at a lower end thereof.

The first bevel gear 214 is mounted on an end of the first bevel gear shaft 214*a*, which is engaged with the second bevel gear 215 mounted on a second bevel gear shaft 201 having a square shape in section.

The operation lever 213 is combined with the first bevel gear shaft 214*a,* which makes the first bevel gear shaft 214*a* to be rotated in the forward or reverse directions when the operation lever 213 is pushed by the carriage 410. On the other hand, the operation lever 213 is moved along the first bevel gear shaft 214*a* when being shifted by the clutch 213*b*. If the operation lever 213 is not moved, the shifting plates 211 and 211' are present in a horizontal state.

The second bevel gear shaft 210 extends through a first housing 201, of which one end is supported by a second housing 202. The first and second housings 201 and 202 has a hinge axis at one end thereof which is distal from the second bevel gear shaft 210. A guide plate 218 is extended between the first and second housings 201 and 202.

The guide plate 218 has an uneven upper surface 219, which is engaged with a locking element 217 disposed in the first housing 201 to restrain the first housing 201 as well as to change a position of the first housing 201.

In the case of changing the position of the first housing 201, the locking element 217 is pushed to be released from the uneven surface 219 of the guide plate 218 and then the position of the first housing 201 can be changed.

Figure 3:
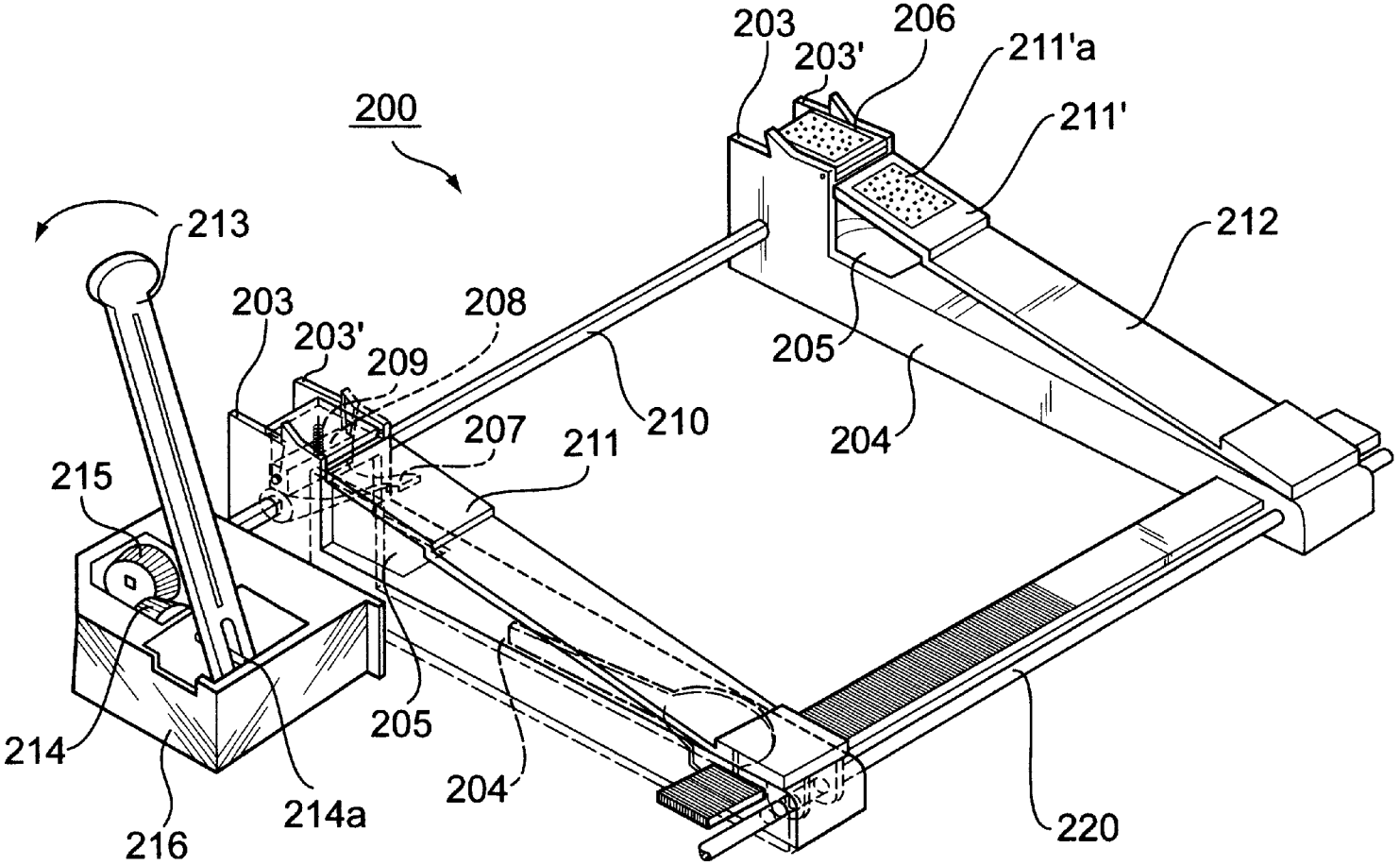
FIG. 3 shows an operation of the shifting means for shifting the recordable paper stacking plate according to the present invention.

FIG. 3 is a view of the device for feeding the recordable paper in the ink jet printer, in which the shifting plate is in the shifted state. Referring to FIG. 3, the carriage 410 is moved along the guide shaft 102 to push the operation lever 213 which is positioned outside the printing region outward. The operation lever 213 is outward moved and the first bevel gear shaft 214*a* is clockwise rotated. On the other hand, the second bevel gear 215 engaged with the first bevel gear 214 is counterclockwise rotated together with the second bevel gear shaft 210 as the first bevel gear 214 mounted on the first bevel gear shaft 214*a* is clockwise rotated.

The shifting lever 207 is rotated by the second bevel gear shaft 210 to shift the shifting plate 211 upward, which in turn is pivoted on the hinge shaft 220 to be decline. At the same time, an operation member 208 is upward moved along guide channels formed in side was 203 and 203' to decline paper guiding plates 206 as the shifting lever is rotated.

Since the shifting plates 211 and 211' disposed on supporting plates 204 and the paper guiding plates 206 are declined in the same direction, the recordable paper can be smoothly fed by the feed roller 320 as the stacking plate is disposed on the shifting plates 211 and 211'.

When the printing is started and the feed roller 320 is rotated in the forward direction, the clutch 213*b* connected to a shaft of the feed roller is clockwise rotated to push the operation lever 213 from the guide shaft 102 to the main frame 101. Accordingly, the operation lever 213 is not operated even if the carriage 410 is reciprocally moved along the guide shaft 102.

As described above, even though the operation lever 213 is moved by the clutch 213*b* forward and backward, the first bevel gear shaft 214*a* is not rotated and the second bevel gear shaft 210 also is not rotated.

Figure 4:
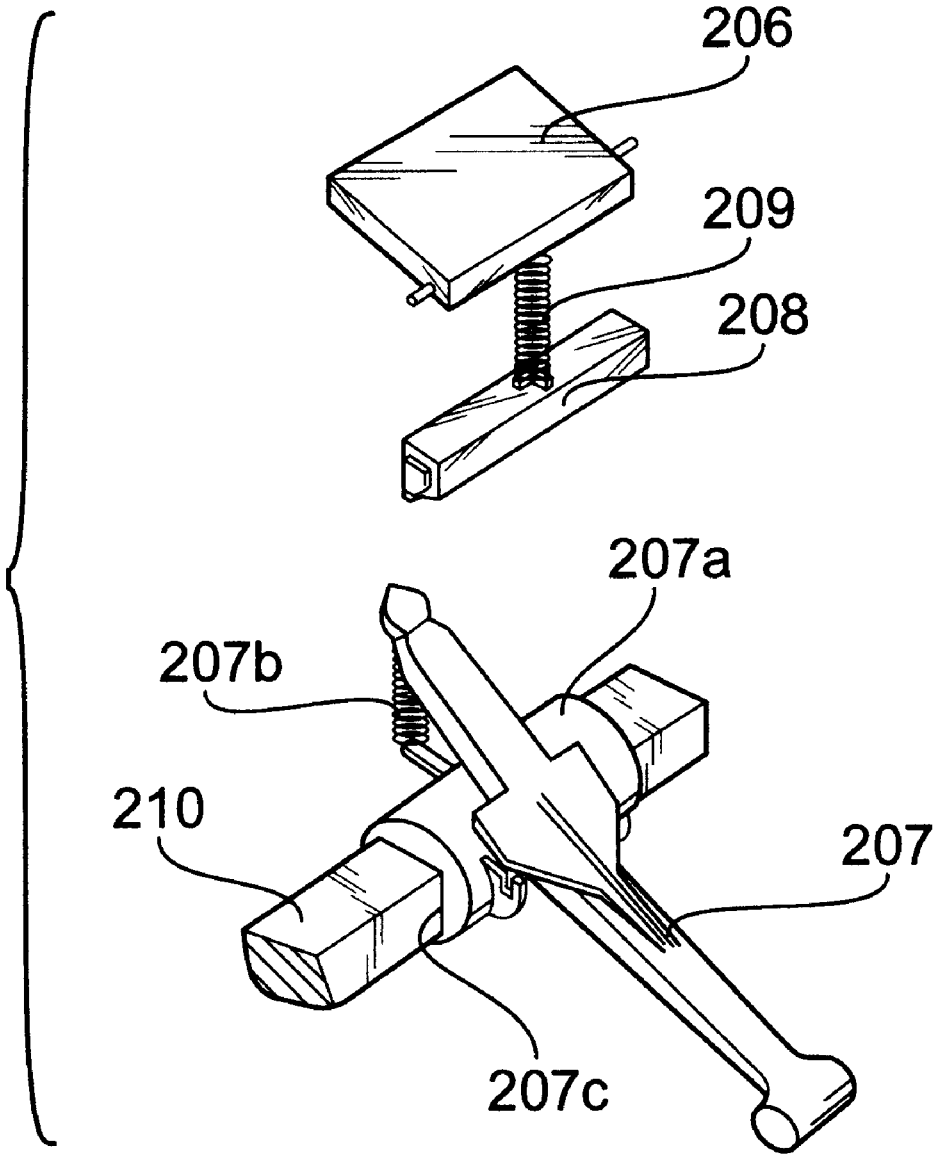
FIG. 4 is an exploded perspective view of a shifting lever according to the present invention.

FIG. 4 is an exploded perspective view of a shifting lever according to the present invention. Referring to FIG. 4, the shifting lever 207 is assembled with a shifting lever support 207*a* and a spring 207*b* is disposed between the shifting lever 207 and the shifting lever support 207*a*. A throughhole 297*c* is formed in the shifting lever support 207*a*, through which the second bevel gear shaft 210 is extended. Thus, the shifting lever support 207*a* is rotated together with the second bevel gear shaft 210.

When the second bevel gear shaft 210 is rotated, the shifting lever 207 is shifted upward to push the operating member 208 so that the paper guiding plate 206 is declined by means of a resilient force of the spring 209.

Figure 5:
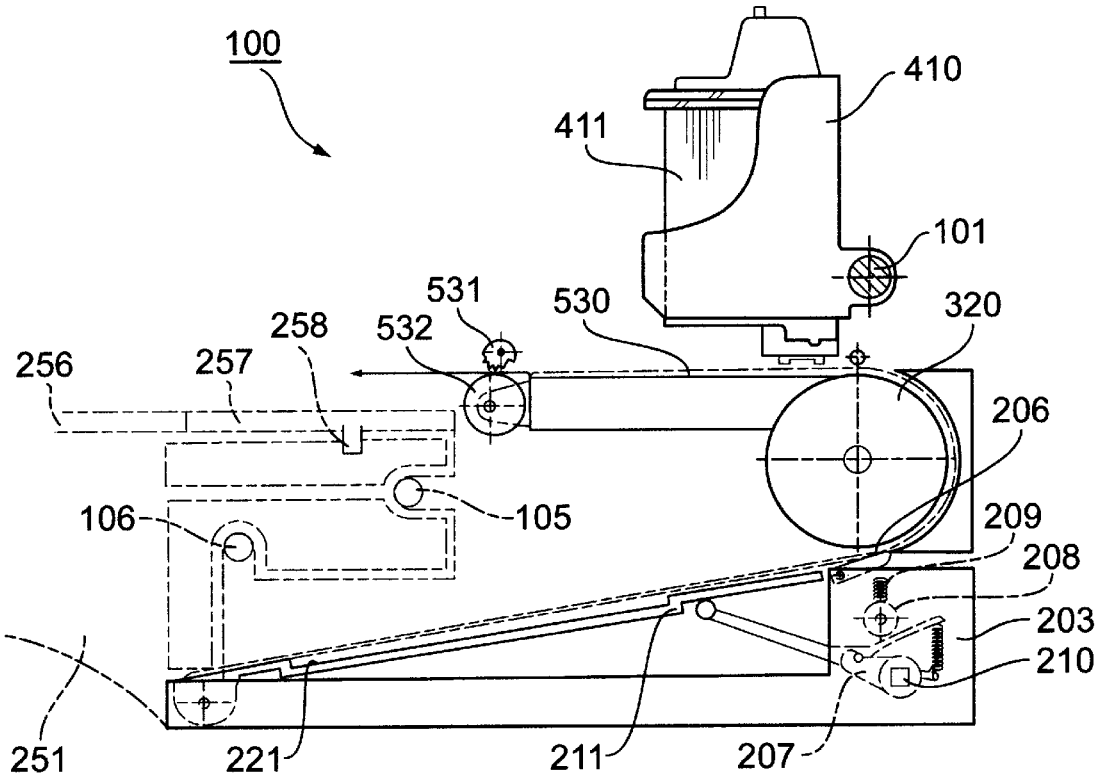
FIG. 5 is a sectional view of the ink jet printer according to the present invention, which shows an operation of feeding the recordable paper in the ink jet printer

FIG. 5 is a sectional view of the ink jet printer according to the present invention, which shows an operation of feeding the recordable paper in the ink jet printer.

When an initial printing is started or the carriage 410 is moved along the guide shaft 102 to push the operation lever 213 outward in order to feed a new recordable paper, as described above, the second bevel gear shaft 210 is rotated to shift the shifting levers 207 disposed in the first and second housings upward. Thus, the shifting plates 211 and 211' are raised by the shifting levers 207.

At the same time, the shift lever 207 raises the operating member 208, which in turn shifts the paper guiding plate 206 upward. Accordingly, the paper guiding plate 206 is declined.

Then, the recordable paper stacked on the stacking plate 221 is picked-up by the feed roller 320 and moved to an upper portion of the base frame 530 during the rotation of the feed roller 320. At that time, the printhead on the carriage 410 starts to print the data on the recordable paper.

As described above, the feed roller 320 picks-up and moves the recordable paper stacked on the stacking plate 221 of the device for feeding the recordable paper in the ink jet printer.

At the end, the recorded paper is discharged from the printer by means of a star-shaped wheel 531 and a discharging roller 532 to be stacked on the first recorded paper receiving plate 256 and the second recorded paper receiving plate 257.

A reference numeral 105 indicates the first projection and 106 indicates the second projection. Also, a reference numeral 251 indicates a side wall and 258 indicates the connecting latch used for combining the first and second recorded paper receiving plates 256 and 257 with the side wall 251.

As described above, the recordable paper is picked up by a rotation of the feed roller and moved to a base frame. As a result, it is possible to save a time for feeding the recordable paper and printing data on the recordable paper. Further, there is advantage in that a time for picking up the recordable paper can be reduced by using a CR motor having a large torque.

While the present invention has been particularly shown and described with reference to a particular embodiment thereof, it will be understood by those skilled in the art that various changes in form and detail may be effected therein without departing from the scope of the invention as defined by the appended claims.

What is claimed is:

1. A device for feeding a recordable paper in a printer, comprising:

a main frame having a guide shaft;

means being reciprocally moved along said guide shaft, for printing characters;

a plate disposed at a front side of said main frame, stacking said recordable paper thereon;

a feed roller disposed at a front portion of said main frame, feeding said recordable paper stacked on said plate to a printing region of said printing means;

means disposed out of said printing region of said printing means, for receiving a driving force from said printing means at an initial printing; and means for shifting said plate upward and downward using said driving force receiving means so that said recordable paper is positioned at a pick-up position of said feed roller.

2. The device as claimed in claim 1, further comprised of means for preventing an interference between said printing means and said driving force receiving means during the reciprocation of said printing means in such a manner that when said feed roller is reversely rotated at said initial printing, said driving force receiving means is made in contact with said guide shaft to receive the driving force during the reciprocation of said printing means while said driving force receiving means is disconnected from said guide shaft when the printing proceeds.

3. The device as claimed in claim 2, wherein said interference preventing means includes a clutch connected to said feed roller and moving forward and backward and a tension spring supporting said driving force receiving means and the clutch.

4. The device as claimed in claim 1, wherein said plate shifting means includes a rotating means for converting a linear movement of the printing means into the rotating movement when said printing means pushes said driving force receiving means, a rotating shaft rotated by said rotating means, means disposed below said plate for stacking said recordable paper thereon, for contacting said plate to said feed roller closely using a rotation of said rotating shaft, and means for receiving a rotation force of said rotating shaft and for moving said contacting means.

5. The device as claimed in claim 4, wherein said rotating means includes a gear shaft combined with a lower end of said driving force receiving means to be rotated, a first bevel gear mounted on said gear shaft to be rotated together with said gear shaft, and a second bevel gear mounted on said rotating shaft and engaged with said first bevel gear to rotate said rotating shaft.

6. The device as claimed in claim 4, wherein said contacting means includes a shifting plate for shifting said plate for stacking said recordable paper thereon, a guide plate for guiding a leading edge of said stacking plate upward shifted by said shifting plate toward said feed roller, and a hinge shaft mounted so that a rear end of said shifting plate is pivoted on said hinge shaft and a leading edge of said shifting plate is upward shifted.

7. The device as claimed in claim 6, wherein said shifting plate is divided into two shifting plates are connected to each other through a member guiding to support said stacking plate, one of said two shifting plates being fixed to said guiding member while the other is slidably movable along said guiding member and positioned according to a size of the recordable paper stacked on said stacking plate.

8. The device as claimed in claim 4, wherein said shifting means includes a shifting lever for moving said contacting means using the rotation of said rotating shaft and a support for fixing said shifting lever to said rotating shaft.

9. The device as claimed in claim 1, further comprised of an auxiliary paper stacking plate for supporting said recordable paper fed to said stacking plate and a discharged paper stacking plate on which a discharged paper is stacked in said main frame.

10. The device as claimed in claim 9, wherein a plurality of the auxiliary stacking plates are designed to be stacked on each other and respectively have a width gradually decreased from a rear end to a front end thereof, of which a lower plate is received in a bottom portion of an upper plate.

11. A device for feeding a sheet of paper in a printer, comprising:

a main frame having a guide shaft;

a carriage member connected to said guide shaft, printing said paper;

a plate disposed at a front side of said main frame, stacking said paper;

a feed roller disposed at a front portion of said main frame, feeding said paper to a printing region of said carriage member;

a lever disposed out of said printing region, receiving a dividing force from said carriage member; and a shifting member connected to said lever, moving said plate upward and downward by using said driving force.

12. The device of the claim 11, further comprised of a clutch preventing said lever from receiving said driving force from said carriage member.

13. The device of the claim 11, further comprised of said lever receiving said driving force from said carriage member at an initial printing.

14. The device of the claim 11, further comprised of a clutch located between said lever and said feed roller, preventing said lever from receiving said driving force from said carriage member.

15. The device of the claim 11, further comprised of said shifting member moving said plate upward after said driving force is received, and said feed roller rotating in a forward direction to feed said paper to said printing region.

16. The device of the claim 11, further comprised of said shift member moving said plate downward when said feed roller rotates in a reverse direction after printing.

* * * * *